US010232975B2

(12) United States Patent
Palmer et al.

(10) Patent No.: US 10,232,975 B2
(45) Date of Patent: Mar. 19, 2019

(54) PRODUCT PACKAGING WITH INTEGRATED SUPPORT

(71) Applicant: Bose Corporation, Framingham, MA (US)

(72) Inventors: Christopher G. Palmer, Pleasanton, CA (US); Robert Warden, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/681,036

(22) Filed: Aug. 18, 2017

(65) Prior Publication Data

US 2019/0055051 A1 Feb. 21, 2019

(51) Int. Cl.

| | |
|---|---|
| ***B65D 85/02*** | (2006.01) |
| ***B65D 5/50*** | (2006.01) |
| ***B65D 5/02*** | (2006.01) |
| ***B65D 5/42*** | (2006.01) |
| ***B65D 5/60*** | (2006.01) |

(Continued)

(52) U.S. Cl.

CPC ..... *B65D 5/5004* (2013.01); *B65D 5/0281* (2013.01); *B65D 5/4212* (2013.01); *B65D 5/4266* (2013.01); *B65D 5/60* (2013.01); *B65D 81/027* (2013.01); *B65D 85/30* (2013.01)

(58) Field of Classification Search

CPC ..... B65D 5/4212; B65D 5/4266; B65D 5/60; B65D 81/027; B65D 85/30; B65D 25/02; B65D 75/327; B65D 73/02; B65D 75/36; B65D 5/5004; B65D 5/0281

USPC ..... 206/521, 587–589, 524, 784, 486, 734, 206/730, 723–725, 461, 485, 721, 722, 206/701, 702, 320, 736, 765, 525.1, 591, 206/5, 92, 594

See application file for complete search history.

(56) References Cited

U.S. PATENT DOCUMENTS 3,253,703 A * 5/1966 Ettin ..... B65D 5/20 206/784

4,953,705 A 9/1990 Evamy (Continued)

FOREIGN PATENT DOCUMENTS

| | | |
|---|---|---|
| EP | 1902964 A1 | 3/2008 |
| WO | 0194236 A1 | 12/2001 |

OTHER PUBLICATIONS

PCT International Search Report and Written Opinion for International Application No. PCT/US2018/000305, dated Nov. 21, 2018, 11 pages.

*Primary Examiner* — Rafael A Ortiz

(74) *Attorney, Agent, or Firm* — Hoffman Warnick LLC

(57) ABSTRACT

Various implementations include packaging for products. In some particular implementations, a product package includes: a base section having: a base inner core section having: a central section including a recess sized to receive an accessory of the product; and a plurality of foldable end sections adjacent the central section and configured to fold at an angle relative to the central section; and a base cover sized to directly contact and cover the base inner core section; and an upper section sized to complement the base section, the upper section having: an upper inner core section having: a central section; and a plurality side sections adjacent the central section; and an upper cover sized to directly contact and cover the upper inner core section.

20 Claims, 10 Drawing Sheets

(51) Int. Cl.
*B65D 81/02* (2006.01)
*B65D 85/30* (2006.01)

(56) References Cited

U.S. PATENT DOCUMENTS

| | | | | | |
|---|---|---|---|---|---|
| 5,462,171 | A * | 10/1995 | Moog | B65D 81/113 | 206/588 |
| 6,302,274 | B1 * | 10/2001 | Ridgeway | B65D 5/5038 | 206/583 |
| 7,167,360 | B2 * | 1/2007 | Inoue | G06F 1/181 | 174/544 |
| 7,549,537 | B2 * | 6/2009 | Hsu | B65D 5/5038 | 206/486 |
| 2004/0000500 | A1 * | 1/2004 | Hsu | B65D 5/5038 | 206/486 |
| 2012/0279899 | A1 * | 11/2012 | Hsieh | B65D 5/5021 | 206/740 |
| 2014/0027337 | A1 * | 1/2014 | Marchetti | B65D 81/05 | 206/521 |

* cited by examiner

PRODUCT PACKAGING WITH INTEGRATED SUPPORT

TECHNICAL FIELD

This disclosure generally relates to product packaging. More particularly, the disclosure relates to product packaging having integrated support features for cushioning or otherwise reinforcing products stored therein.

BACKGROUND

A growing number of consumer products, e.g., consumer electronics, are being packaged and shipped to distributors, retailers and consumers. The packaging for these products often includes a plurality of disjointed support structures and padding packed into a box or other carrying case in order to prevent damage to the product. This conventional packaging can fail to showcase the packaged product, and present an off-brand image to the consumer.

SUMMARY

All examples and features mentioned below can be combined in any technically possible way.

Various implementations include product packages with integrated support structures. In some implementations, these product packages can be used to package electronic products.

In some particular aspects, a package for a product includes: a base section having: a base inner core section having: a central section including a recess sized to receive an accessory of the product; and a plurality of foldable end sections adjacent the central section and configured to fold at an angle relative to the central section; and a base cover sized to directly contact and cover the base inner core section; and an upper section sized to complement the base section, the upper section having: an upper inner core section having: a central section; and a plurality side sections adjacent the central section; and an upper cover sized to directly contact and cover the upper inner core section.

In another aspect, a product assembly includes: a product; and a package containing the product, the package including: a base section having: a base inner core section having: a central section including a recess holding an accessory of the product; and a plurality of foldable end sections adjacent the central section and positioned at an angle relative to the central section along sides of the product; and a base cover directly contacting the base inner core section; and an upper section complementing the base section, the upper section having: an upper inner core section having: a central section; and a plurality side sections adjacent the central section and extending along the sides of the product; and an upper cover directly contacting and covering the upper inner core section.

Implementations may include one of the following features, or any combination thereof.

In some implementations, the base inner core section and the upper inner core section include honeycomb structured corrugated cardboard.

In some cases, the central section of the base inner core section includes a plurality of distinct core layers stacked over one another. In some implementations, the recess in the central section is positioned within an upper core layer in the plurality of distinct core layers, and the plurality of distinct core layers includes at least one continuous planar core layer positioned below the upper core layer.

In certain cases, the plurality of foldable end sections include four end sections. In some implementations, the four end sections each have a first end and a second, opposite end, and each of the first end and the second end include a v-mitered edge sized to mate with a v-mitered edge of an adjacent one of the four end sections.

In some cases, the recess is smaller than a smallest dimension of the product.

In particular implementations, the package includes a non-woven fiber sleeve for encasing the product between the base section and the upper section. In some cases, the base cover and the upper cover are positioned to directly contact the non-woven fiber sleeve.

In some implementations, the package includes a removable seal for coupling the base section with the upper section.

In some cases, the base section and the upper section are sized to slidingly fit over portions of the product.

In certain implementations, the base section and the upper section are configured to be flattened to a thickness equal to approximately a thickness of the base inner core section.

In some cases, at least one of the base section or the upper section further includes a closeable aperture on an outer surface thereof for accessing the recess while the base section is coupled with the upper section. In some implementations, the closeable aperture includes a door integral with at least one of the base cover section or the upper cover section, wherein the door includes an actuatable fastener for at least one of coupling or decoupling with the at least one of the base cover section or the upper cover section.

In certain cases, the base cover includes at least one fastener for securing about the base inner core section, and the upper cover includes at least one fastener for securing about the upper inner core section.

In some implementations, the base cover includes a removable cover coinciding with the recess for providing access to the recess from a product-side surface of the base cover.

In certain cases, the central section includes at least one extension configured to fold into a shoulder directly contacting the base cover.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
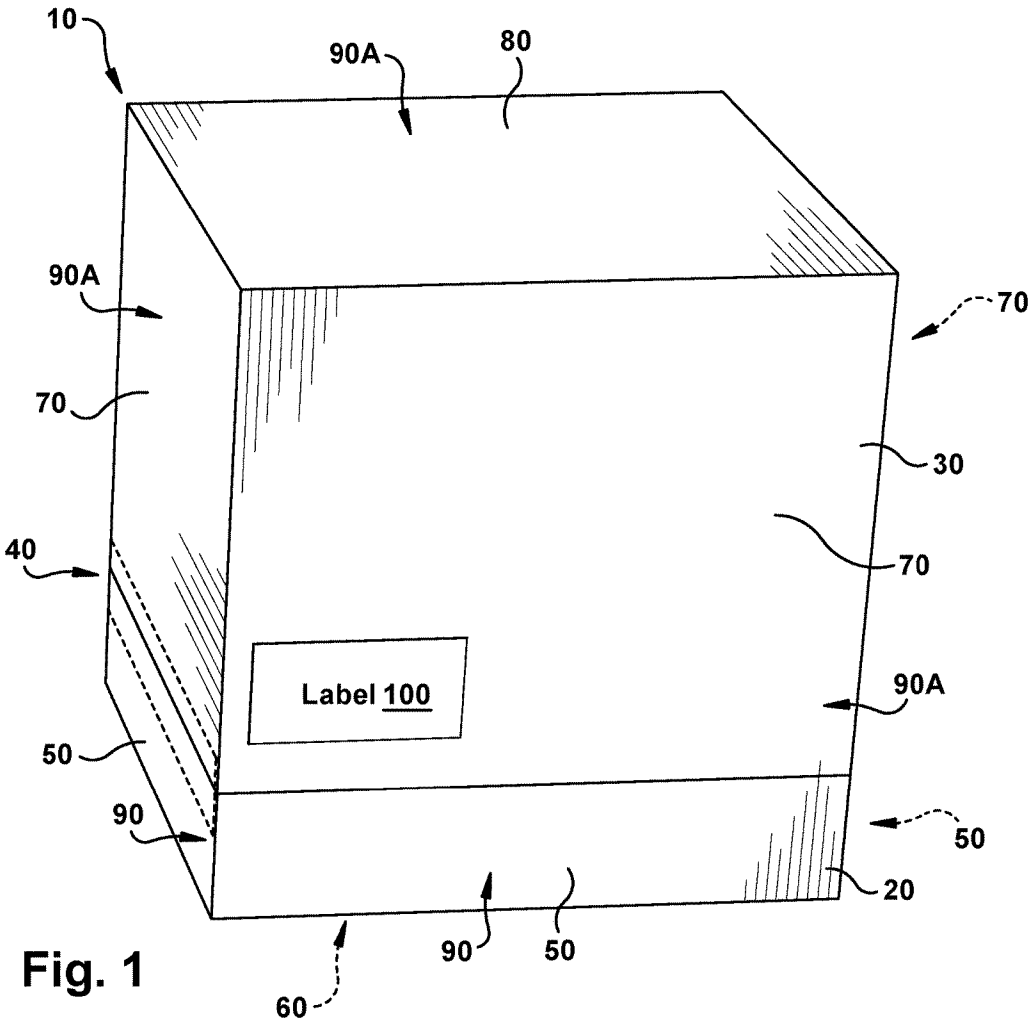
FIG. 1 shows a perspective view of an assembled product package according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a supportive packaging configuration can be beneficially incorporated into a product package. For example, a product package can provide an integrated support structure with a cover or wrap layer that provides an effective, esthetically pleasing, supportive structure for the product.

Commonly labeled components in the FIGURES are considered to be substantially equivalent components for the purposes of illustration, and redundant discussion of those components is omitted for clarity.

As described herein, conventional packaging configurations present products packaged therein along with disjoined support structures that are clumsy and often difficult to load and/or unload from the packaging. For example, some packaging configurations enclose a product (e.g., an electronic product) in a segmented casing of a foam/polystyrene padding or other padded material within a box. When a user opens the box, that user must slide one or more segments of the casing out of the box in order to access the product. Additionally, the product is often locked into the casing at notches or grooves, making it even more cumbersome to load and/or unload the product from the packaging. Even further, residue from the foam/polystyrene or other padded material often adheres to the product in these configurations, as the support material is in direct contact with the product.

In contrast to conventional product packaging, various implementations of the disclosure include a package with an integrated support structure (or core) for supporting the product. This core can be hidden from the product-facing side of the packaging, but directly contact that product-facing side of the package cover. In some cases, this core is a multi-section core having foldable sections for at least partially wrapping the product to provide side/lateral support. When a user opens the product packaging, that user is presented with the product (and in some cases, an intermediate sleeve or scratch-resistant soft casing) sitting directly on the package cover. That is, the user does not interact with additional support structures (e.g., padding, inserts, etc.) within the package cover. This allows the user to directly interface with the product from the moment that user opens the package.

FIG. 1 shows a perspective view of an assembled product package 10 according to various implementations. As shown in this view, product package 10 can include a base section 20 and an upper section 30 sized to complement the base section 20. That is, that base section 20 and upper section 30 are sized to be removably coupled to one another and to accommodate a product within these sections when coupled. In some example embodiments, as shown in phantom in FIG. 1, product package 10 further includes a removable seal 40 for coupling the base section 20 with the upper section 30. Removable seal 40 can include an adhesive material such as a static-tension strip, tape, a lamination, an adhesive label, a corrugated clip mechanism, etc. In some cases, removable seal 40 can be placed along one or more sides of the base section 20 and upper section 30 to hold these sections together, and in some cases, the removable seal 40 can include a tab or other easily actuatable mechanism for removing that seal and uncoupling base section 20 and upper section 30.

It is understood that the relative proportions, sizes and shapes of base section 20, upper section 30, removable seal 40 and components and features thereof as shown in FIG. 1 and other FIGURES included herein can be merely illustrative of such physical attributes of these components. That is, these proportions, shapes and sizes can be modified according to various implementations to fit a variety of products. For example, while a substantially cube-shaped product package may be shown according to particular implementations, it is understood that the product package could also take on other three-dimensional shapes in order to contain a product and provide integrated support functions described herein.

Returning to FIG. 1, product package 10 is shown including base section 20, which has a plurality of sides (two obstructed in this view) 50, and a bottom 60 (also obstructed in this view) extending between opposing sides 50. In various depictions, obstructed features are shown with dashed indicator lines. Upper section 30 can include a plurality of sides 70 (two obstructed in this view) that are substantially coplanar with sides 50 of base section 20, and a top 80 extending between opposing sides 70. In certain cases, as described herein, the sides 50 and bottom 60 of base section 20 can be wrapped or covered in a (e.g., substantially homogeneous) cover material (or simply, cover) 90, and the sides 70 and top 80 of upper section 30 can be wrapped or covered in a (e.g., substantially homogeneous) cover material (or simply, cover) 90A, e.g., a paper such as a neutral-colored paper providing sufficient contrast with a label 100 such that a user (e.g., human user or optically enabled robotic device) can detect features of the label 100 as distinct from cover 90. In some implementations, as described further herein, the sides 50 and bottom 60 of base section 20 can be wrapped or covered in a single piece of the cover material 90, and the sides 70 and top 80 of upper section 30 can be wrapped or covered in a single piece of cover material 90A. That is, in some cases, cover 90 and/or cover 90A, can include a single, continuous piece of material wrapped around a respective inner core section (described further herein). In various implementations, cover material 90 and cover material 90A can be identical material types, e.g., a paper such as corrugate paper (e.g., C, E or F flute material), C1S (coated one side), C2S (coated two side), vat-dyed paper (of desired thickness), SBS (bleached sulfate material), CCNB (clay coated news back) etc.

Figure 2:
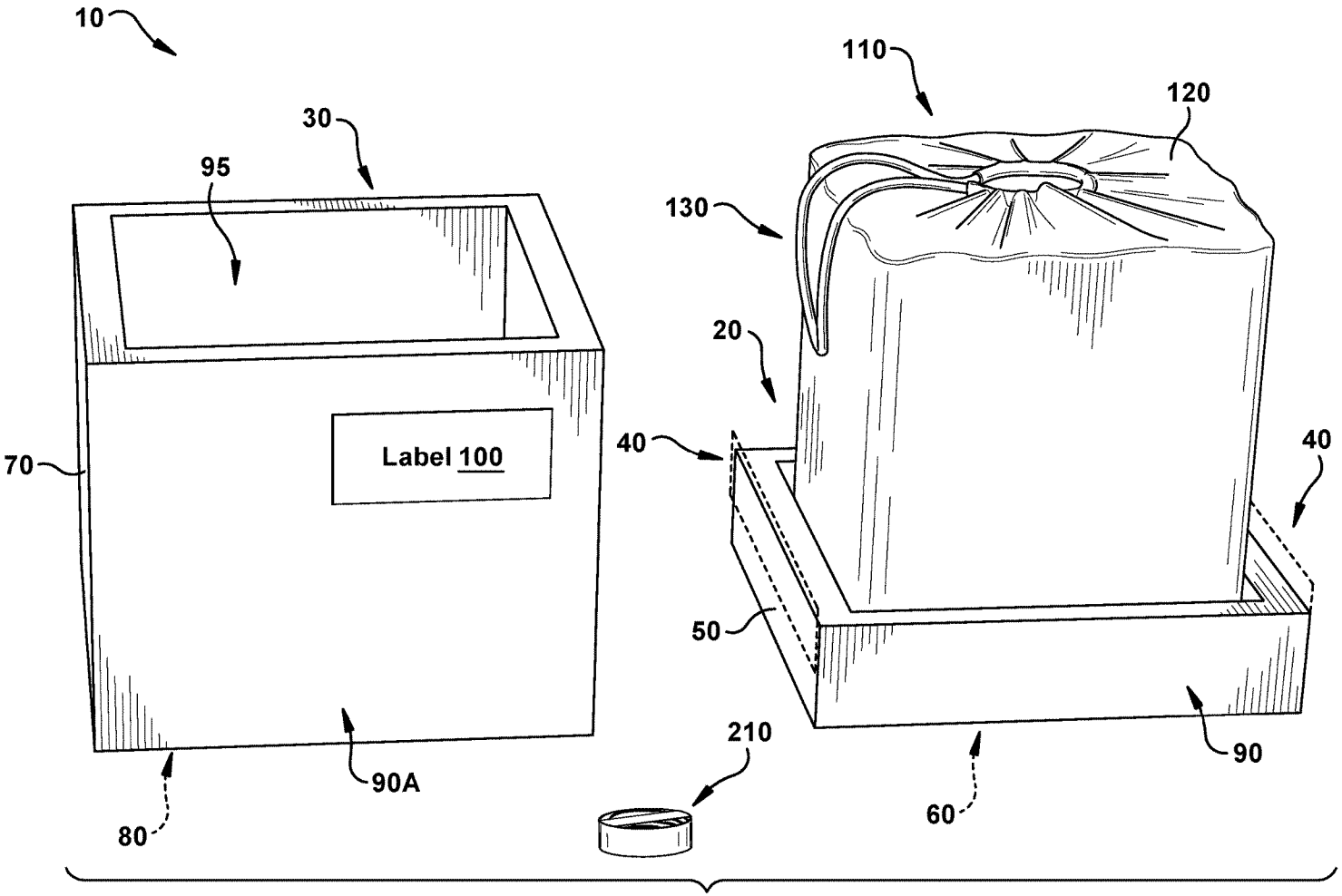
FIG. 2 shows a break-out perspective view of a product package with a product and an accessory according to various implementations.

FIG. 2 shows a break-out schematic view of product package 10 with upper section 30 removed from base section 20 (e.g., where upper section 30 has been flipped to rest on top 80). As can be seen in this view, cover 90A is present on the product-facing surfaces 95 (i.e., inner surfaces of sides 70 and top 80) of upper section 30. That is, inner core sections (further described herein) of the upper section 30 are not visible when upper section 30 is removed from base section 20. As is further shown in FIG. 2, in some cases, the package 10 can house (or otherwise at least partially contain) a product 110. In various implementations, product 110 includes an electronic component such as a speaker system, headphone system, etc. In some example implementations, product 110 can be wrapped or otherwise covered (e.g., at least partially covered) by a sleeve 120. In some cases, sleeve 120 can include a non-woven fiber sleeve (e.g., polymer-based material) for encasing the product 110 between the base section 20 and the upper section 30. In some cases, sleeve 120 can include another scratch-resistant material such as a natural fiber material or other polymer-based material. Sleeve 120 can include a scratch-resistant material configured to prevent scratching or other undesirable marking on product 110 while product 110 is stored, transported, packed, un-packed etc. In some cases, sleeve 120 can include a bag or enclosure with a drawstring 130 for opening/closing sleeve 120 around product 110. In various particular implementations, base cover 90 and upper cover 90A are positioned to directly contact sleeve 120, e.g., to slidingly fit product 110 and sleeve 120 within base section 20 and upper section 30. However, it is understood that according to various implementations, sleeve 120 is not necessary or included in package 10, such that product 110 is positioned to directly contact base cover 90 and upper cover 90A within the assembled package 10.

Figure 3:
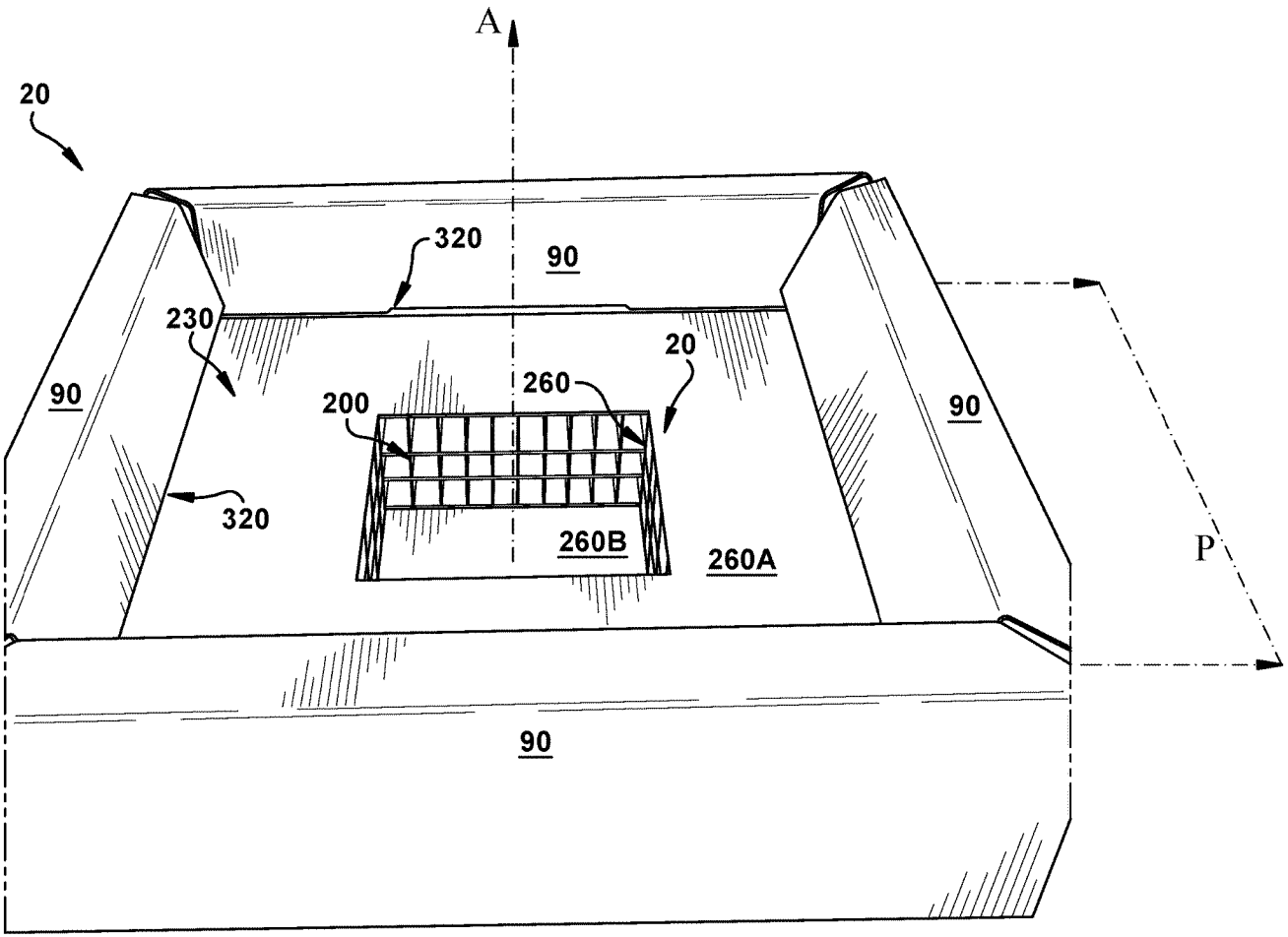
FIG. 3 shows a perspective view of an example product package base section according to various implementations.

As described further herein, and shown in FIGS. 2 and 3, in various embodiments, an inner core section of the base section 20 forms a recess 200 (FIG. 3) sized to receive an accessory 210 of the product 110 (FIG. 2).

Accessory 210 can include a component, manual, literature, adapter, etc. for use in conjunction with product 110 or relevant to product 110. For example, an accessory 210 can include a cord for product 110, e.g., a power cord/adapter, USB connector or other external cord. However, in other implementations, accessory 210 can include a product manual, usage instructions and/or warnings, etc. that are relevant to product 110. In various implementations, accessory 210 can include a product-specific, or region-specific (e.g., country, continent, language region) component such as a power cord/adapter for particular voltage outlets or a product manual in a particular language or with particular disclaimers or warnings based upon regional regulations. As discussed herein, a recess (e.g., recess 200, FIG. 3) can be accessible from a product-facing surface of the base section 20 (e.g., from an inner surface of walls 50 or bottom 60), or from another surface (e.g., an outer surface such as one of sides 50 or bottom 60 of base section 20 or, one of sides 70 or top 80 of the upper section 30) of product package 10.

Figure 4:
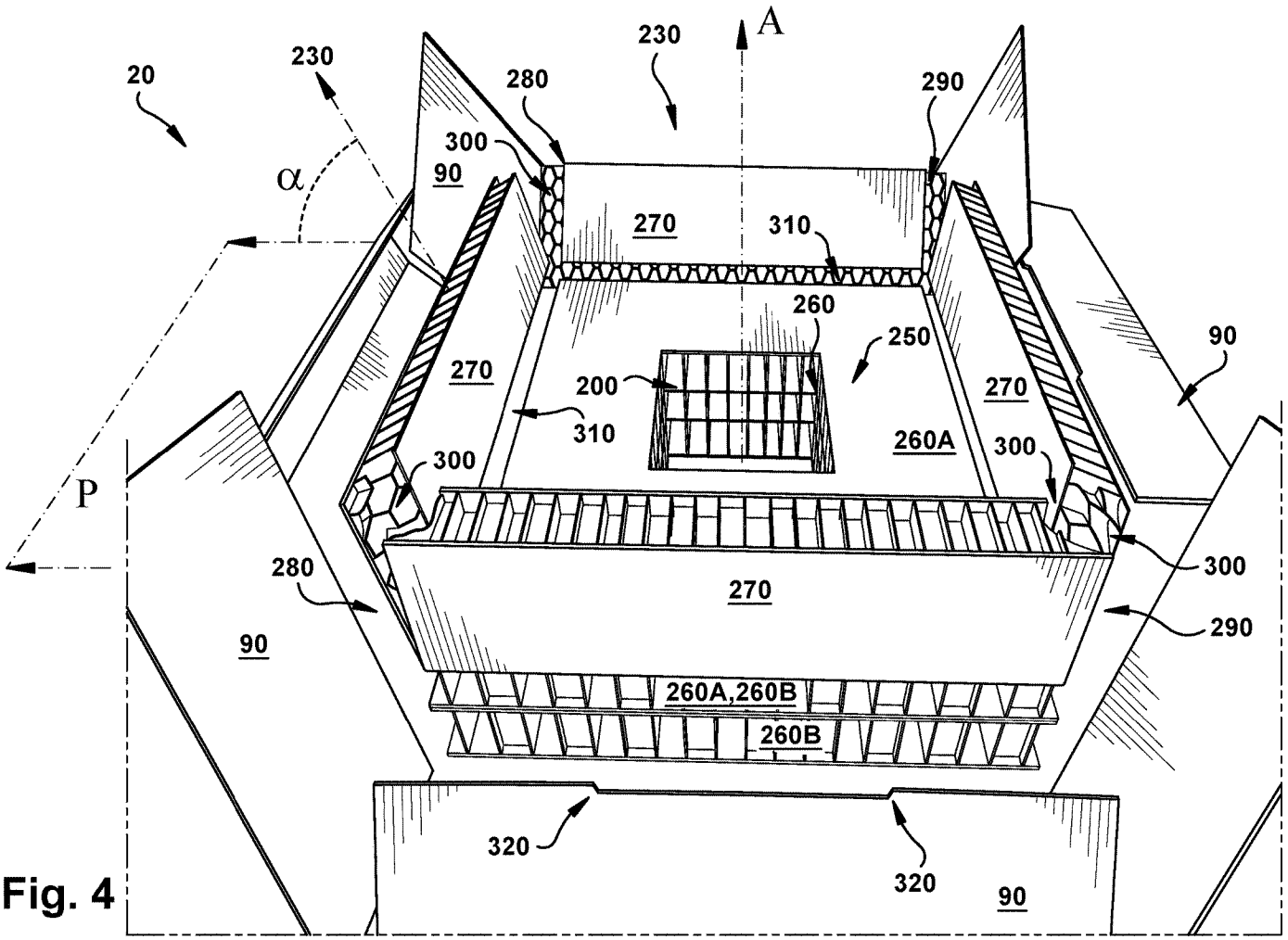
FIG. 4 shows a break-out perspective view of the example product package base section of FIG. 3.
Figure 5:
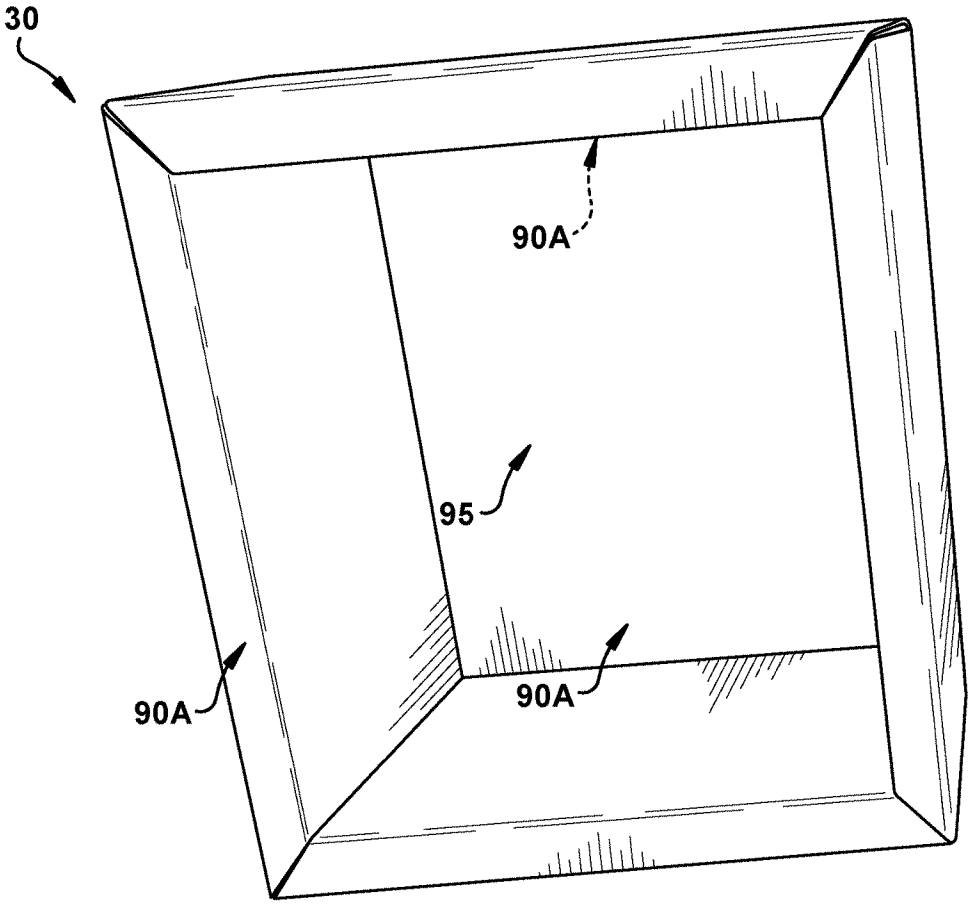
FIG. 5 shows a perspective view of an example product package upper section according to various implementations.
Figure 6:
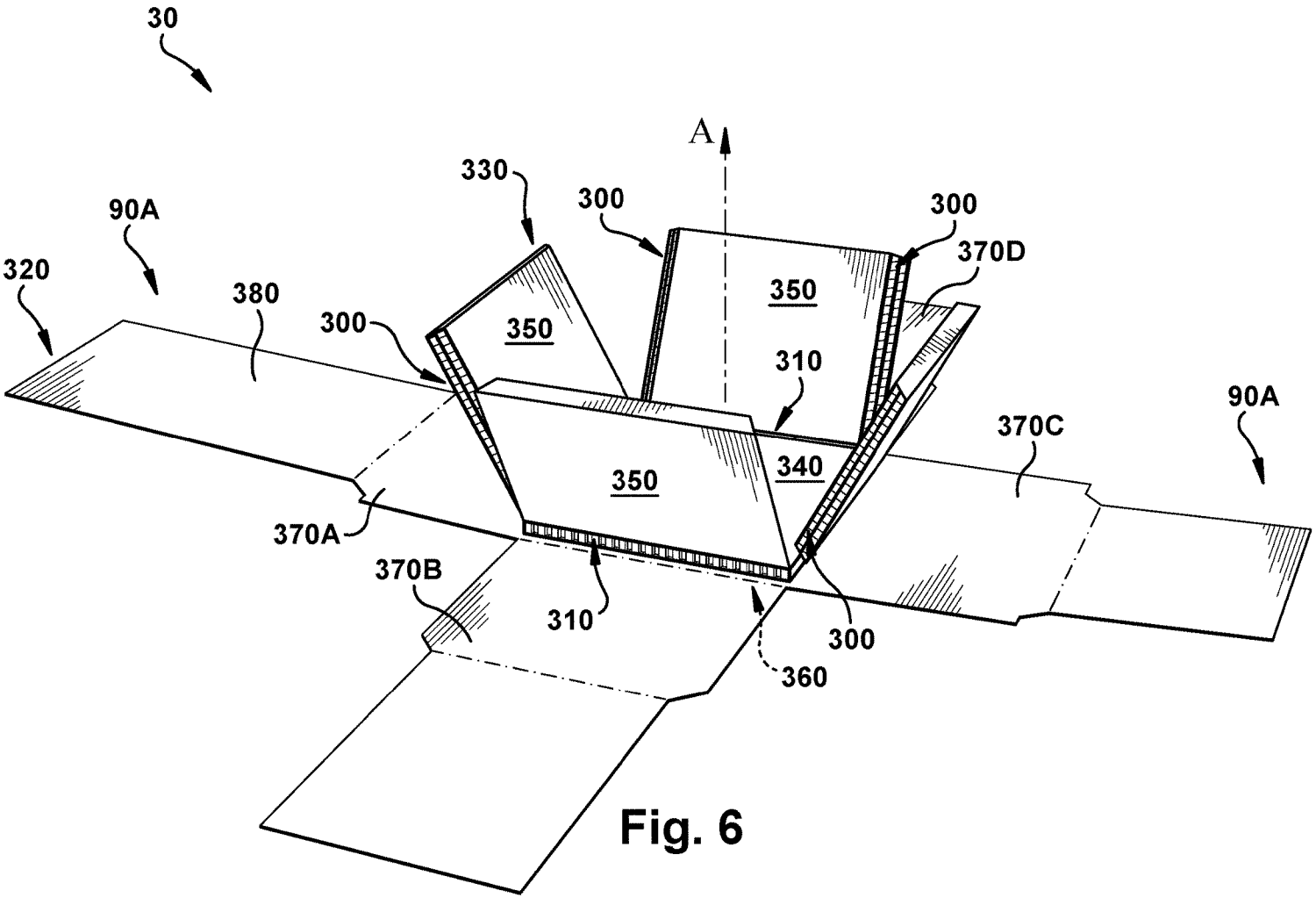
FIG. 6 shows a break-out perspective view of the example product package upper section of FIG. 5.

FIGS. 3-6 illustrate additional features of base section 20 and upper section 30 of product package 10. In particular, base section 20 is shown in FIGS. 3 and 4 including an inner base core section 230, and upper section 30 is shown in FIGS. 5 and 6 including an upper inner core section 240. As described further herein, inner base core section 230 can be positioned inside base cover 90 (e.g., such that base inner core section 230 is at least partially wrapped by cover 90), and upper inner core section 240 can be positioned inside upper cover 90A (e.g., such that inner base core section 230 is at least partially wrapped by upper cover 90A).

In particular, FIG. 3 shows a schematic three-dimensional depiction of base section 20, including the base inner core section 230 and base cover 90 at least partially covering base inner core section 230. FIG. 4 shows a break-out view of base section 20, illustrating various additional features of the inner base core section 230 and base cover 90. As shown in FIG. 3 and FIG. 4, base inner core section 230 can include a central section 250 including a recess 200, sized to receive the accessory 210 of product 110. Central section 250 can substantially surround a central vertical axis (A) of the package 10, and provide primary vertical support for the product 110 when positioned within package 10. In some implementations, central section 230 can include a plurality of distinct core layers 260 stacked over one another. For example, as shown in FIG. 3 and FIG. 4, central section 250 can include at least one upper core layer 260A having an opening defining the recess 200 (i.e., such that recess 200 is positioned within that upper core layer 260A) and at least one continuous planar core layer 260B positioned below the upper core layer 260A. As noted herein, a planar area of the recess 200 (e.g., as measured across plane (P) that is coplanar with the surface of upper core layer(s) 260A, can be smaller than a smallest dimension of the product 110 (e.g., smaller than the area of a smallest side of product 110).

In this example in FIGS. 3 and 4, central section 250 includes three distinct upper core layers 260A (defining the depth of recess 200, e.g., as three layers deep), and at least one continuous planar core layer 260B. However, any number of upper core layers 260A and/or continuous planar core layers 260B can be used to form central section 250 according to product specifications (e.g., weight, expected shipping conditions, sensitivity to turbulence in transit/delivery). For example, additional core layers 260 may result in a deeper recess 200. That is, in some cases, a single core layer 260 could be utilized according to various implementations. However, in other implementations, a plurality of core layers 260 could be utilized (e.g., two or more), as shown in example implementations in FIGS. 3 and 4. The continuous planar core layer 260B forms a continuous plane across the central section 250 and does not include the recess 200. As such, continuous planar core layer 260B can provide support for the accessory 210 stored within recess 200. In various implementations, each of the distinct core layers 260 can include honeycomb structured corrugated cardboard. That is, each of the distinct core layers 260 can include a honeycomb core sandwiched between linerboard to provide support for the product 110 at each of those distinct core layers 260. In various implementations, the honeycomb structured corrugated cardboard may be a recyclable, all-natural material. In some cases, the honeycomb structured corrugated cardboard has a density that is tailored to a desired (or required) cushioning for the weight, size, or other characteristic of the product 110. In some cases, the thickness of each of the core layers 260 is tailored to the desired (or required) cushioning for the weight, size, or other characteristic of the product 110. However, it is understood that layers 260A, 260B of central section 250 can also be formed of other paper-based, plastic-based or composite materials capable of cushioning product 110 within package 10. For example in other implementations, layers 260 could include one or more layers of cardboard, foam, plastic etc. sufficient to provide cushioning for the product 110 according to desired characteristics.

With continuing reference to FIG. 3, but particular attention to FIG. 4, additional features of the base inner core section 230 are realized. That is, base inner core section 230 can additionally include a plurality of foldable end sections 270 adjacent central section 250, which are configured to fold at an angle relative to the central section 250. As shown in FIG. 4, the foldable end sections 270 can be configured to align at an angle (a) relative to the plane (P) of upper core layer 260A, and in some cases, may align with upper core layer 260A such that angle (a) is between approximately 5 degrees and 85 degrees relative to plane (P). In some cases, angle (a) is slightly less (e.g., 5-10 degrees less) than 90 degrees. As with core layers 260, in some implementations, foldable end sections 270 can include honeycomb structured corrugated cardboard, or any other material described with respect to core layers 260. In some cases, foldable end sections 270 can include four end sections 270, e.g., four distinct pieces of honeycomb structured corrugated cardboard. In some implementations, the four end sections 270 each have a first end 280 and a second, opposite end (second end) 290. In various implementations, each of the first end 280 and the second end 290 include a v-mitered edge 300 sized to mate with a v-mitered edge 300 of an adjacent one of the four end sections 270. In other implementations, a straight-cut edge could be used to join end sections 270 (e.g., with a butt joint), at the desired angle (a). That is, according to various particular implementations, the v-mitered edges 300 are shaped to complement each other such that the end sections 270 can be positioned at angle (a) relative to the plane (P) and form a continuous perimeter around upper core layer(s) 260A. In some cases, end sections 270 directly contact upper core layer(s) 260A and at least partially rest on those upper core layer(s) 260A and adjacent end sections 270. As shown in FIG. 4, in some particular implementations, end sections 270 can also include an angled edge 310 (e.g., beveled, edge, chamfered edge, mitered edge) spanning between first end 280 and second end 290 (e.g., on one side of end section 270) for permitting end sections 270 to stand adjacent upper core layer(s) 260A without additional support (e.g., stand freely with only support from underlying continuous planar core layer 260B and adjacent end sections 270). In these embodiments, the continuous planar core layer(s) 260B can have a greater planar area (e.g., as measured across plane P) than upper core layer(s) 260A to create a ledge upon which end sections 270 can stand at angle (a). FIG. 4 shows these end sections 270 standing on continuous planar core layer 260B along a ledge that is defined by the difference in area between that continuous planar core layer 260B and the overlying upper core layer 260A.

Also shown in FIG. 3 and FIG. 4 is one embodiment of base cover 90, sized to directly contact and cover the base inner core section 230. In various embodiments, as noted herein, base cover 90 can include a single piece of cover material (e.g., paper) sized to wrap around portions of (or substantially all of) the base inner core section 230. Base cover 90 can include at least one fastener 320 for securing itself about the base inner core section 230. In these cases, fastener 320 can include a slot/groove, mating tab/opening or other male/female mating configuration for retaining base cover 90 after it has been wrapped around portions of the base inner core section 230. In the example configuration shown in FIGS. 3 and 4, base cover 90 is sized to wrap around base inner core section 230 (covering continuous planar core layer 260B, intermediate upper core layer(s) 260A and end sections 270) and leave upper(most) core layer 260A exposed. However, in other cases, base cover 90 can be sized to completely cover base inner core section 230, and can include a corresponding aperture for permitting access to recess 200, along with a removable cover coinciding with the recess. In these implementations, one dimension of base cover 90 could be longer than one or more other dimensions to cover the inner core section 230 when folded over end sections 270, as is similarly shown and described with respect to upper section 30 in FIG. 6. In these implementations, the removable cover can provide access to the recess 200 from a product-side surface of the base cover 90. As noted herein, base cover 90 is positioned to directly contact base inner core section 230, e.g., without any intervening padding or other material.

FIG. 5 shows a schematic three-dimensional depiction of the upper section 30 from the product-facing surfaces 95, including upper inner core section 330 (FIG. 6) and upper cover 90A at least partially covering upper inner core section 330. FIG. 6 shows a break-out view of upper section 30, illustrating various additional features of the upper inner core section 330 and upper cover 90A (where upper inner core section 330 is obstructed from view at the product-facing surface). As shown in FIG. 6, upper inner core section 330 can include a central section 340 and a plurality of side sections 350 adjacent the central section 340. As described with respect to base inner core section 230, the term "central" can refer to an orientation relative to the primary axis (A) of package 10 (FIG. 3, FIG. 4 and FIG. 6) when assembled. Central section 340 and side sections 350 can each be formed of a honeycomb structured corrugated cardboard or other material similar to the base inner core sections 230 (or any other material described herein). In various particular implementations, central section 340 can include a single layer of material (e.g., honeycomb structured corrugated cardboard), however, in other implementations, central section 340 can include a plurality of stacked layers of the material (e.g., depending upon desired cushioning for product 110). In some cases, each of the side sections 350 can include at least one v-mitered edge 300 and an angled edge 310 for permitting the side sections 350 to be arranged in a substantially perpendicular manner relative to central section 340. That is, as discussed with respect to base inner core section 230, each of the side sections 350 can include v-mitered edges 300 on opposing sides of each side section 350 for complementing the corresponding v-mitered edge 300 on an adjacent side section 350. Further, as discussed with respect to base inner core section 230, these side sections 350 can additionally include an angled edge 310 for permitting side sections 350 to stand on (or at least partially rest against) central section 340. It is understood that in some implementations, central section 340 can also include an angled edge 310 for interfacing with the angled edge(s) 310 of side sections 350. In some cases, side sections 350 and/or central section 340 can have angled edges 310 that permit the side sections 350 to stand approximately perpendicularly (90 degrees, +/−10 degrees, in particular cases, +/−5 degrees, and in some particular cases, +/−2-3 degrees) relative to central section 340. It is further understood that while v-mitered edges and angled edges are labeled and described commonly herein, those angles and miters can vary depending upon the configuration of particular mating surfaces.

As shown in FIGS. 5 and 6, upper cover 90A can be sized to directly contact and cover upper inner core section 330. That is, as shown in the partial break-out view of FIG. 6, and the perspective view of FIG. 5, upper cover 90A can be sized to wrap around upper inner core section 330 and completely cover side sections 350. In some cases, upper cover 90A can include a continuous piece of material (e.g., paper) that is sized to completely cover side sections 350 and central section 340, as illustrated in FIG. 6. In these implementations, upper cover 90A includes a central section 360 (underlying the outer surface of central section 340) and four distinct wings 370A, 370B, 370C and 370D extending from central section 360. At least one of the wings 370A includes an elongated cover section 380 for covering the inner surface of the central section 340 of upper inner core section 330. The elongated cover section 380 can give wing 370A a greater length than the remaining wings 370B, 370C, 370D as measured from a common (e.g., central) location on central section 360. The remaining wings 370B, 370C, 370D can be sized to wrap around each of the side sections 350 and terminate at approximately the inner surface of the central section 340. In some cases, the upper cover 90A includes at least one fastener 320 for securing itself about the upper inner core section 330. In these cases, fastener 320 can include a slot/groove, mating tab/opening or other male/female mating configuration for retaining upper cover 90A after it has been wrapped around portions of the upper inner core section 330, or the entire upper inner core section 330 (as in the embodiments in FIG. 5 and FIG. 6).

In certain implementations, as can be seen in FIGS. 3-6, the base section 20 and/or the upper section 30 are configured to be flattened to a thickness equal to approximately a thickness of the base inner core section 230, and in some cases, can be flattened to a thickness equal to approximately a thickness of one of the core layers 260, end sections 270, etc. That is, the modular nature of the base inner core section 230 and upper inner core section 330 can permit these sections to be dis-assembled and stored at a thickness equal to approximately one to two of their internal layers (e.g., core layers 260, end sections 270). This can allow the robust packaging configurations described herein to be stored, transported, etc. in a space-saving manner.

Figure 7:
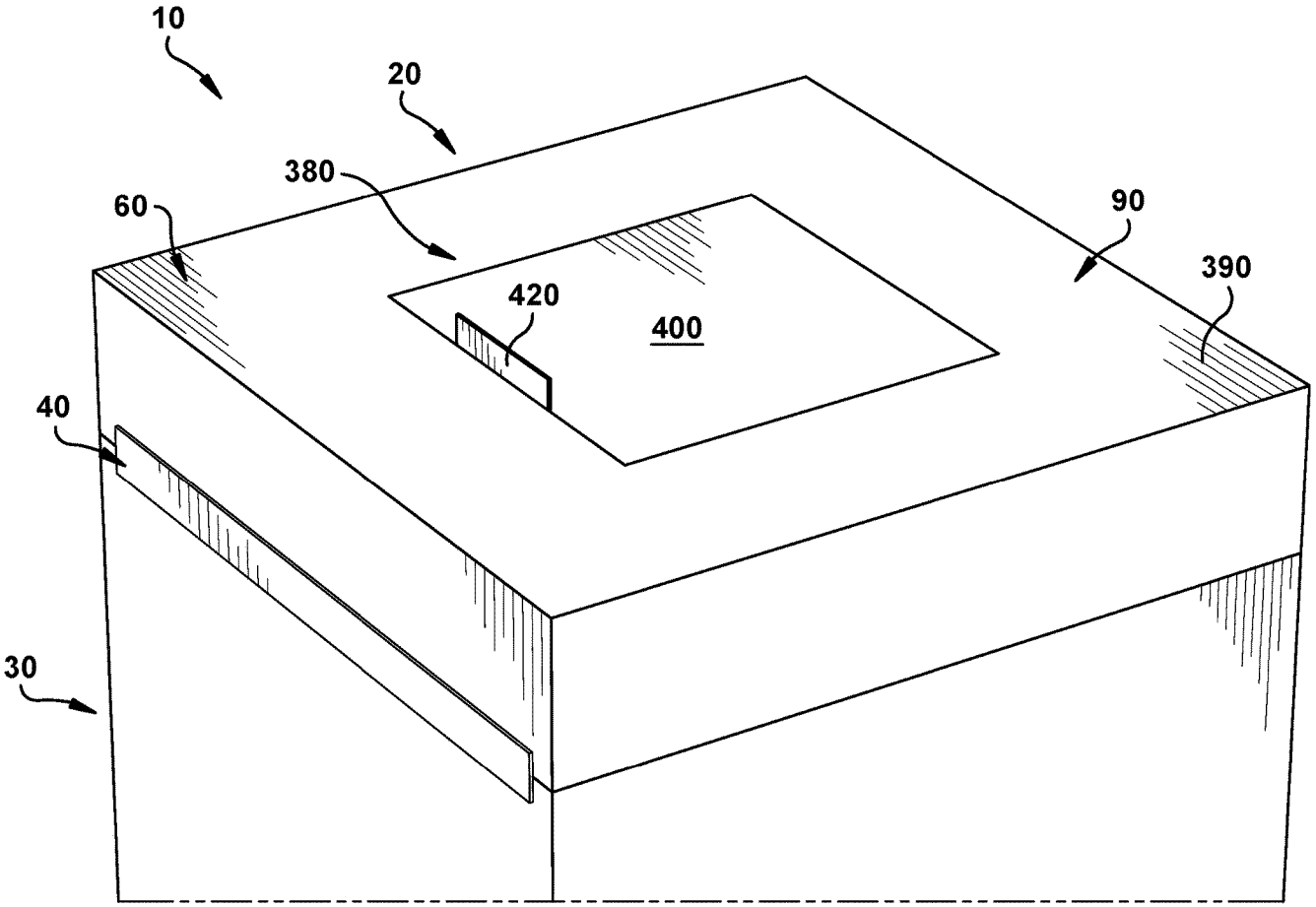
FIG. 7 shows a perspective view of an additional aspect of a product package according to particular implementations.
Figure 8:
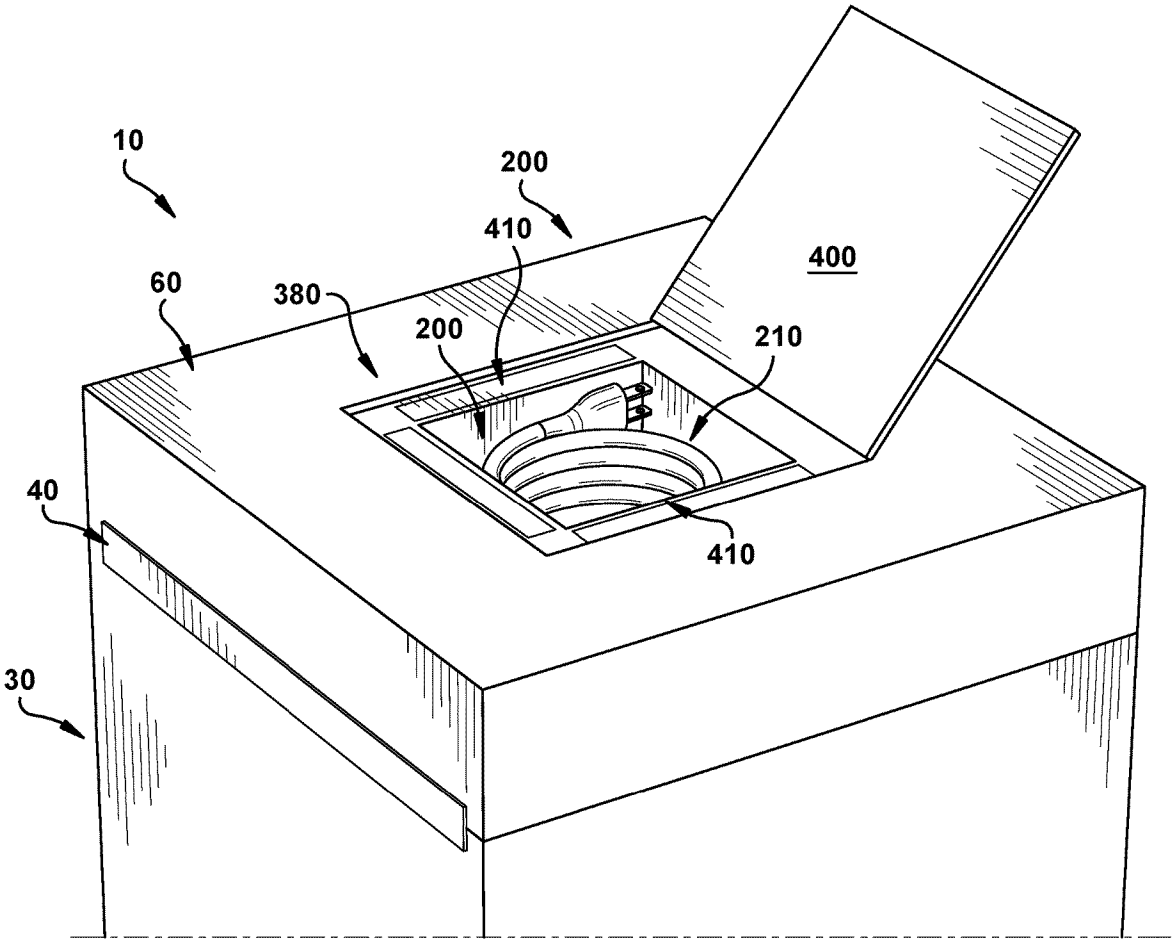
FIG. 8 shows actuation of a feature of the product package of FIG. 7, according to particular implementations.

FIGS. 7 and 8 illustrate an additional implementation where at least one of the base section 20 or the upper section 30 further includes a closeable aperture 380 on an outer surface 390 thereof for accessing a recess (e.g., recess 200 in FIGS. 3 and 4) while the base section 20 is coupled with the upper section 30. It is understood that according to these implementations, the recess 200 shown in FIGS. 3 and 4 may be modified to allow for access from the outer surfaces 390 of package 10. For example, the base inner core section 230 may be modified to allow for access to recess 200 via closeable aperture 380. In this case, the continuous planar core layer 260B (FIGS. 3 and 4) may be modified to form an additional aperture with access to recess 200, or continuous planar core layer 260B may be replaced with an upper core layer 260A that includes an aperture for permitting access to recess 200.

This example implementation in FIGS. 7 and 8 illustrates the closeable aperture 380 shown on the outer surface 390 of base section 20 (where package 10 is inverted in this view, and aperture 380 extends through cover 90 on the bottom 60 of base section 20). However, it is understood that the closeable aperture 380 could be located on any outer surface 390 of base section 20 and/or upper section 30 to permit access to an internal recess while the base section 20 is coupled with the upper section 30 (e.g., as shown coupled by removable seal 40). In some implementations, the closeable aperture 380 includes a door 400 integral with at least one of the base cover section 20 or the upper cover section 30 (base cover section 20 example shown). In some cases, the door 400 can be formed in the base cover 90 or the upper cover 90A, and can include a perforated piece of cover material (e.g., a perforated or otherwise cut piece of the material of the cover). In this example, door can include an actuatable fastener 410 (e.g., FIG. 8) for at least one of coupling or decoupling with the at least one of the base cover section 20 or the upper cover section 30. In some cases, the actuatable fastener 410 can include a single-use adhesive, reusable adhesive or binding strip (e.g., re-sealable adhesive, tape, or other adhesive for single-use purposes) for coupling portions of the door 400 with the remainder of the base cover section 20 (or upper cover section 30, in other examples). FIG. 7 illustrates one example implementation where door 400 includes a tab 420 (e.g., a tab of material such as cloth, paper or plastic) for actuating the actuatable fastener 410. In some cases, tab 420 protrudes from the outer surface 390 and can permit a user to access the recess (e.g., recess 200) via the aperture 380. In these implementations, a user can gain access to the recess within package 10 while the base section 20 is coupled with the upper section 30. This configuration may provide various benefits, in that the package 10 can be accessible for customization/modification after the product 110 has been packaged. For example, when sending the package 10 with product 110 to a distributor, packager, or other intermediary, the recess (e.g., recess 200, FIGS. 3 and 4) can be accessible to add/remove accessories 210 particular to the product 110 and/or destination.

Figure 9:
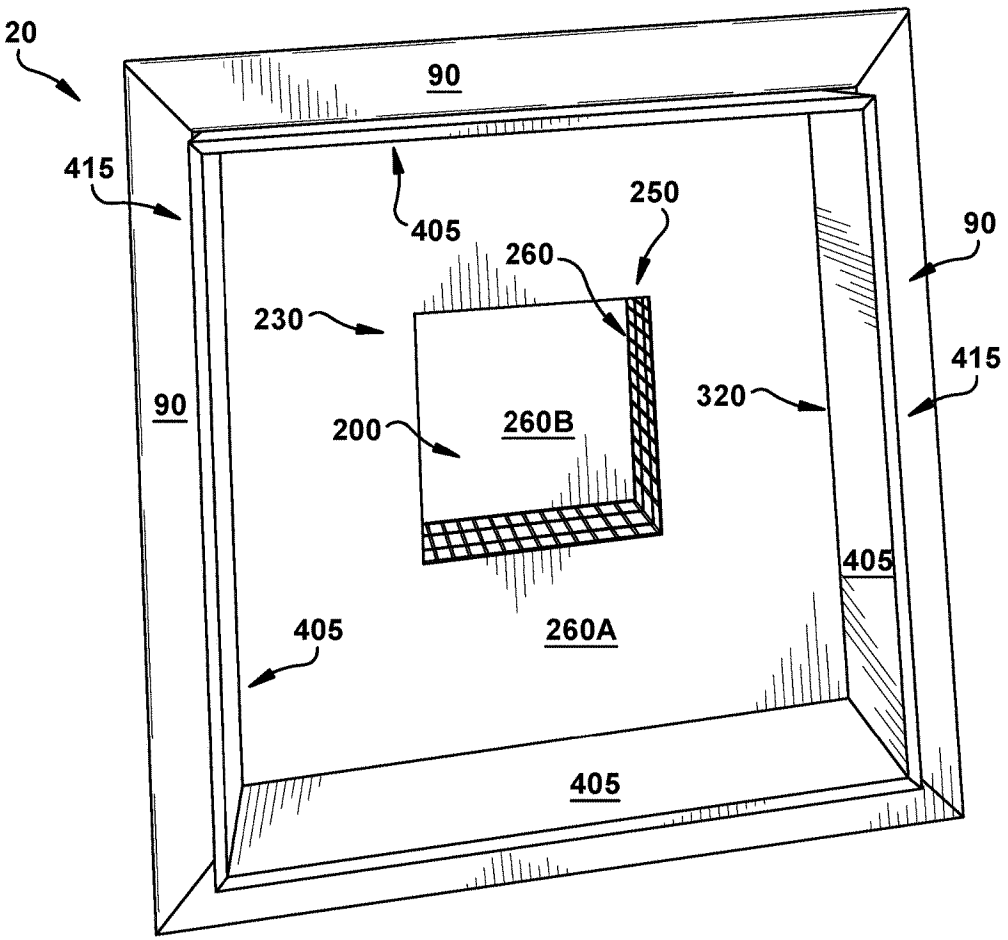
FIG. 9 shows a perspective view of an example product package base section according to various additional implementations.

FIG. 9 illustrates an additional feature of a base section 20 according to various implementations. As shown in FIG. 9, in some implementations, the base inner core section 230, and in particular, the upper core layer 260A, can also include additional material configured to be formed into a shoulder 405 about the perimeter of the upper core layer 260A (extending along cover 90 within end sections 270 (FIG. 4). That is, upper core layer 260A can include a plurality of extensions 415 that are sized to fold at an angle relative to the upper surface of upper core layer 260A (e.g., at approximately a 90 degree angle with plane P (FIG. 3) in order to force base cover 90 away from the interior of the base section 20 (e.g., away from recess 200). In these implementations, extensions 415 can include one or more layers of material (e.g., similar to base cover 90 or a top sheet of the corrugated cardboard of upper core layer 260A) that can be folded up into a shoulder 405, and secured (e.g., using one of fasteners 320) along the inner border of the end sections 270 (FIG. 4). In some implementations, shoulder 405 can extend to a height (in axial direction A, FIG. 3) that is greater than the height of base cover 90 over end sections 270. In this sense, shoulder 405 extends above base cover 90 in base section 20. In various implementations, shoulder 405 can directly contact base cover 90. In some implementations, shoulder 400 can enhance positioning, loading and/or unloading of product 110 from base section 20, and in some cases, may provide a frame for product 110 within base section 20 (and upper section 30) when package 10 is assembled.

Figure 10:
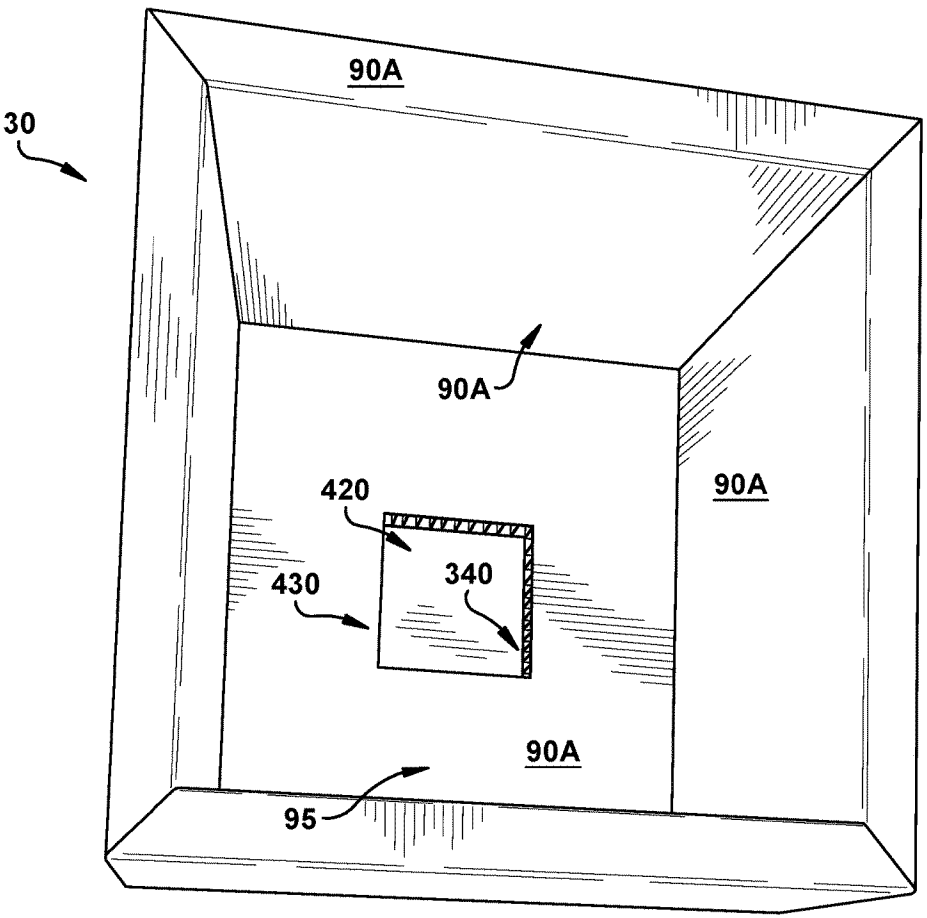
FIG. 10 shows a perspective view of an example product package upper section according to various additional implementations.

FIG. 10 shows an additional feature of an upper section 30 according to various implementations. As shown in FIG. 10, in some implementations, the upper central section 340 of the upper inner core section 330 can include an upper recess 420. In some cases, upper recess 420 extends through at least a portion of the upper inner core section 330 (e.g., through upper central section 340), and also extends through upper cover 90A (e.g., with an opening 430 through upper cover 90A). In various particular implementations, upper recess 420 can be used to house one or more portions of the product 110 when package 10 is assembled, e.g., the drawstring 130 or other extension of sleeve 120 (FIG. 2), a cover for the product 110 or any other extension from an upper surface of the product 110 proximate the upper section 30.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A package for a product, the package comprising:
- a base section having:
  - a base inner core section having:
    - a central section including a recess sized to receive an accessory of the product; and
    - a plurality of foldable end sections adjacent the central section and configured to fold at an angle relative to the central section; and
  - a base cover sized to directly contact and cover the base inner core section; and
- an upper section sized to complement the base section, the upper section having:
  - an upper inner core section having:
    - a central section; and
    - a plurality side sections adjacent the central section; and
  - an upper cover sized to directly contact and cover the upper inner core section.

2. The package of claim 1, wherein the base inner core section and the upper inner core section include honeycomb structured corrugated cardboard.

3. The package of claim 1, wherein the central section of the base inner core section includes a plurality of distinct core layers stacked over one another.

4. The package of claim 3, wherein the recess is positioned within an upper core layer in the plurality of distinct core layers, and wherein the plurality of distinct core layers includes at least one continuous planar core layer positioned below the upper core layer.

5. The package of claim 1, wherein the plurality of foldable end sections include four end sections.

6. The package of claim 5, wherein the four end sections each have a first end and a second, opposite end, and wherein each of the first end and the second end include a v-mitered edge sized to mate with a v-mitered edge of an adjacent one of the four end sections.

7. The package of claim 1, wherein the recess is smaller than a smallest dimension of the product.

8. The package of claim 1, further comprising a non-woven fiber sleeve for encasing the product between the base section and the upper section.

9. The package of claim 8, wherein the base cover and the upper cover are positioned to directly contact the non-woven fiber sleeve.

10. The package of claim 1, further comprising a removable seal for coupling the base section with the upper section.

11. The package of claim 1, wherein the base section and the upper section are sized to slidingly fit over portions of the product.

12. The package of claim 1, wherein the base section and the upper section are configured to be flattened to a thickness equal to approximately a thickness of the base inner core section.

13. The package of claim 1, wherein at least one of the base section or the upper section further includes a closeable aperture on an outer surface thereof for accessing the recess while the base section is coupled with the upper section.

14. The package of claim 13, wherein the closeable aperture includes a door integral with at least one of the base cover section or the upper cover section, wherein the door includes an actuatable fastener for at least one of coupling or decoupling with the at least one of the base cover section or the upper cover section.

15. The package of claim 1, wherein the base cover includes at least one fastener for securing the base cover about the base inner core section, and wherein the upper cover includes at least one fastener for securing about the at least one upper inner core section.

16. The package of claim 1, wherein the base cover includes a removable cover coinciding with the recess for providing access to the recess from a product-side surface of the base cover.

17. The package of claim 1, wherein the central section includes at least one extension configured to fold into a shoulder directly contacting the base cover.

18. A product assembly comprising:
- a product; and
- a package containing the product, the package including:
  - a base section having:
    - a base inner core section having:
      - a central section including a recess holding an accessory of the product; and
      - a plurality of foldable end sections adjacent the central section and positioned at an angle relative to the central section along sides of the product; and
    - a base cover directly contacting the base inner core section; and
  - an upper section complementing the base section, the upper section having:
    - an upper inner core section having:
      - a central section; and
      - a plurality side sections adjacent the central section and extending along the sides of the product; and
    - an upper cover directly contacting and covering the upper inner core section.

19. The product assembly of claim 18, further comprising:
- a non-woven fiber sleeve encasing the product between the base section and the upper section, wherein the base cover and the upper cover directly contact the non-woven fiber sleeve; and
- a removable seal coupling the base section with the upper section.

20. The product assembly of claim 18, wherein the base inner core section and the upper inner core section include honeycomb structured corrugated cardboard.

* * * * *